US010119217B2

(12) United States Patent
Del Pos et al.

(10) Patent No.: US 10,119,217 B2
(45) **Date of Patent: *Nov. 6, 2018**

(54) LAUNDRY WASHING MACHINE INCLUDING A DETERGENT DRAWER WITH A PUSH MEMBER

(71) Applicant: Electrolux Appliances Aktiebolag, Stockholm (SE)

(72) Inventors: Maurizio Del Pos, Pordenone (IT); Daniele Favaro, Venice (IT)

(73) Assignee: Electrolux Appliances Aktiebolag (SE)

( * ) Notice: Subject to any disclaimer, the term of this patent is extended or adjusted under 35 U.S.C. 154(b) by 338 days.

This patent is subject to a terminal disclaimer.

(21) Appl. No.: 14/901,361

(22) PCT Filed: Jun. 28, 2013

(86) PCT No.: PCT/EP2013/063611

§ 371 (c)(1),
(2) Date: Dec. 28, 2015

(87) PCT Pub. No.: WO2014/206481

PCT Pub. Date: Dec. 31, 2014

(65) Prior Publication Data

US 2016/0153133 A1 Jun. 2, 2016

(51) Int. Cl.
*D06F 39/02* (2006.01)
*D06F 39/00* (2006.01)
(Continued)

(52) U.S. Cl.
CPC ..... *D06F 39/02* (2013.01); *D06F 39/005* (2013.01); *D06F 39/007* (2013.01); *D06F 29/00* (2013.01); *D06F 39/12* (2013.01); *D06F 43/002* (2013.01)

(58) Field of Classification Search
None
See application file for complete search history.

(56) References Cited

U.S. PATENT DOCUMENTS 7,651,179 B2 * 1/2010 Chirumbolo ..... B60N 3/083 312/319.1
9,499,932 B2 * 11/2016 Seikel ..... D06F 39/02
(Continued)

FOREIGN PATENT DOCUMENTS

DE 102008027726 B3 10/2009
EP 1553161 A1 7/2005
(Continued)

OTHER PUBLICATIONS

International Search Report dated Feb. 12, 2014 in corresponding International Appliation No. PCT/EP2013/063611.
(Continued)

*Primary Examiner* — Rita P Adhlakha
(74) *Attorney, Agent, or Firm* — RatnerPrestia

(57) ABSTRACT

A laundry washing machine (1) includes an outer casing (2) and an appliance control panel (6) located on a front wall (3) of the casing (2). The appliance control panel (6) is arranged on a front side of a drawer-like supporting structure (13) which is inserted in extractable manner into a corresponding drawer housing (14). The drawer-like supporting structure (13) is movable inside the drawer housing (14) between a retracted position and a completely extracted position. The laundry washing machine (1) furthermore includes: a push member (18, 33) which is able to elastically push the drawerlike supporting structure (13) away from the retracted position and towards the completely extracted position; a locking mechanism (19) for automatically holding the drawer-like supporting structure (13) in the retracted position and to prevent the push member (18, 33) from pushing the drawer-like supporting structure (13) away from the retracted position; and a manually operated command device (20) for forcing the locking mechanism (19) to release the drawerlike supporting structure (13), thus allowing the push
(Continued)

member (18, 33) to push the drawer-like supporting structure (13) away from the retracted position.

20 Claims, 8 Drawing Sheets

(51) Int. Cl.

| | |
|---|---|
| *D06F 39/12* | (2006.01) |
| *D06F 43/00* | (2006.01) |
| *D06F 29/00* | (2006.01) |

(56) References Cited

U.S. PATENT DOCUMENTS

| | | | | |
|---|---|---|---|---|
| 2007/0151301 | A1 | 7/2007 | Kendall et al. | |
| 2008/0072632 | A1* | 3/2008 | Je | D06F 39/02 68/17 R |
| 2009/0261697 | A1 | 10/2009 | Hill et al. | |

FOREIGN PATENT DOCUMENTS

| | | | |
|---|---|---|---|
| EP | 1681383 | A1 | 7/2006 |
| EP | 1724387 | A1 | 11/2006 |
| EP | 1860227 | A1 | 11/2007 |
| WO | 2007031779 | A1 | 3/2007 |
| WO | 2011128745 | | 10/2011 |

OTHER PUBLICATIONS

International Search Report dated Feb. 5, 2014 in related International Appliation No. PCT/EP2013/063638.

* cited by examiner

LAUNDRY WASHING MACHINE INCLUDING A DETERGENT DRAWER WITH A PUSH MEMBER

BACKGROUND

The present invention relates to a laundry washing machine.

In particular, the present invention relates to a front-loading home laundry washing machine, to which the following description refers purely by way of example without this implying any loss of generality.

As is known, currently marketed front-loading home laundry washing machines generally comprise: a substantially parallelepiped-shaped outer boxlike casing structured for resting on the floor; a substantially bell-shaped washing tub which is suspended in floating manner inside the casing, directly facing a laundry loading/unloading through opening realized in the front wall of the casing; a substantially cylindrical, elastically-deformable bellows which connects the front opening of the washing tub to the laundry loading/unloading opening formed in the front wall of the casing; a porthole door which is hinged to the front wall of the casing to rotate to and from a closing position in which the door closes the laundry loading/unloading opening in the front wall of the casing for watertight sealing the washing tub; a substantially cylindrical, bell-shaped rotatable drum structured for housing the laundry to be washed, and which is fitted inside the washing tub with its concavity facing the laundry loading/unloading opening and is supported in axially rotating manner so as to be able to freely rotate about its substantially horizontally-oriented longitudinal axis; and an electrically-powered motor assembly which is structured for driving into rotation the rotatable drum about its longitudinal axis inside the washing tub.

Alike any other home laundry washing machine, this type of laundry washing machine furthermore comprises: a detergent dispensing assembly which is generally located inside the boxlike casing, immediately above the washing tub, and is structured for selectively feeding into the washing tub, according to the washing cycle manually-selected by the user, a given amount of detergent, softener and/or other washing agent suitably mixed with fresh water arriving from the water mains; a fresh-water supply circuit which is structured for selectively drawing fresh water from the water mains according to the washing cycle manually-selected by the user, and channelling said water to the detergent dispensing assembly or directly to the washing tub; and finally an appliance control panel which is generally located on the front wall of the casing, above the laundry loading/unloading opening, and is structured for allowing the user to manually select the desired washing-cycle.

The detergent dispensing assembly, in turn, generally comprises a detergent drawer which is typically divided into a number of detergent compartments each structured for being manually fillable with an amount of detergent, softener or other washing agent sufficient to perform a single washing cycle, and which is fitted/inserted in manually extractable manner into a completely recessed drawer housing whose entrance is generally located on the upper right or felt corner of the front wall of the casing, above the laundry loading/unloading opening and beside the appliance control panel.

In the recent years, some household appliance producers decided to widen the detergent drawer up to substantially match the overall width of the boxlike casing, and to locate/arrange the appliance control panel on front of the widened detergent drawer.

WO2011/128745 discloses a front-loading home laundry washing machine having a large detergent drawer and the appliance control panel is located on front side of the detergent drawer. A push-pull or push-push mechanism is also incorporated into the household appliance to facilitate the extraction of the detergent drawer.

Unfortunately, the use of a push-pull or push-push mechanism to facilitate the extraction of the detergent drawer is technically inconsistent with the arrangement of the appliance control panel on front of the detergent drawer. A push-pull or push-push mechanism, in fact, requires the detergent drawer to step back a few millimeters inside the drawer housing to activate, whereas the appliance control panel must remain in a stable abutment on, and perfectly coplanar to, the front wall of the casing when the detergent drawer is completely inserted inside the casing, for both aesthetical and operative reasons.

The user, in fact, is usually required to press one or more manually-operated push-buttons on the appliance control panel to power on the household appliance and/or to select the desired washing cycle, and a push-pull or push-push mechanism would cause an undesired, sudden extraction of the detergent drawer at any press of a push-button.

SUMMARY OF SELECTED INVENTIVE ASPECTS

An aim of the present invention is to facilitate the extraction of the detergent drawer carrying the appliance control panel without the drawbacks referred above.

In compliance with the above aims, according to an aspect of the present invention there is provided a laundry washing machine comprising an outer casing, a washing tub which is arranged inside the casing with its opening or mouth directly facing a laundry loading/unloading opening realized on a the front wall of the casing, a detergent dispensing assembly which is structured for supplying detergent into the washing tub, a fresh-water supply circuit which is structured for being connected to the water mains and for selectively channelling a flow of fresh water from the water mains to the detergent dispensing assembly and/or to the washing tub, and an appliance control panel which is structured for allowing the user to manually select the desired washing-cycle and is located on the front wall of the casing;

the appliance control panel being located/arranged on a front side of a drawerlike supporting structure which is fitted/inserted in extractable manner into a corresponding drawer housing which extends inside the casing underneath the upper worktop or top wall of the casing, and communicates with the outside via a front entrance or opening which is realized on the front wall of the casing above the laundry loading/unloading opening;

the drawer-like supporting structure being movable inside the drawer housing between a retracted position in which the drawer-like supporting structure is completely recessed inside the casing and the appliance control panel is arranged substantially coplanar to the front wall of the casing, and a completely extracted position in which the drawer-like supporting structure partly juts out from the front wall of the casing so as to arrange the appliance control panel forward spaced apart from the front wall of the casing;

the laundry washing machine being characterized by also comprising: a push member which is able to elastically push the drawer-like supporting structure away from the retracted position and towards the extracted position; a locking mechanism which is structured to hold the drawer-like supporting structure in the retracted position and to prevent the push member from pushing the drawer-like supporting structure away from the retracted position; and a manually-operated command device which is structured so as to force, when manually operated, the locking mechanism to release the drawer-like supporting structure, thus allowing the push member to push the drawer-like supporting structure away from the retracted position.

Preferably, though not necessarily, the laundry washing machine is furthermore characterized in that the locking mechanism is at least partially arranged on the drawer-like supporting structure.

Preferably, though not necessarily, the laundry washing machine is furthermore characterized in that the locking mechanism is structured to selectively lock, when the drawer-like supporting structure is arranged in the retracted position, the drawer-like supporting structure to the drawer housing, so as to prevent any movement of the drawer-like supporting structure with respect to the drawer housing.

Preferably, though not necessarily, the laundry washing machine is furthermore characterized in that the locking mechanism is at least partially arranged on the front side of the drawer-like supporting structure, behind the appliance control panel.

Preferably, though not necessarily, the laundry washing machine is furthermore characterized in that the locking mechanism comprises a catch member which protrudes from the drawer-like supporting structure, and has its distal end structured so as to be able, when the drawer-like supporting structure is arranged in the retracted position, to engage in a stable, though easily releasable manner onto a corresponding engagement portion provided at the drawer housing.

Preferably, though not necessarily, the laundry washing machine is furthermore characterized in that the catch member is movable between a locking position wherein the distal end of the catch member is able to engage onto the drawer housing, and an unlocking position wherein the distal end of the catch member is forced to release the drawer housing, and in that the manually-operated command device is structured to selectively move, when manually operated, the catch member from the locking position to the unlocking position so as to force the catch member to release the drawer housing.

Preferably, though not necessarily, the laundry washing machine is furthermore characterized in that the catch member comprises a rocker arm which is pivotally jointed to the drawer-like supporting structure so as to be able to freely swing about a given rotation axis.

Preferably, though not necessarily, the laundry washing machine is furthermore characterized in that the locking mechanism comprises an elastic member which is structured to elastically keep/hold the catch member in the locking position.

Preferably, though not necessarily, the laundry washing machine is furthermore characterized in that said elastic member is arranged on the drawer-like supporting structure.

Preferably, though not necessarily, the laundry washing machine is furthermore characterized in that the locking mechanism is structured to selectively elastically hold the drawer-like supporting structure inside the drawer housing in the retracted position.

Preferably, though not necessarily, the laundry washing machine is furthermore characterized in that the locking mechanism is a flip-flop locking mechanism which is structured so as to able to selectively and alternatively assume a first working configuration wherein the locking mechanism elastically hold the drawer-like supporting structure inside the drawer housing in the retracted position overcoming the thrust of the push member, and a second working configuration wherein the locking mechanism elastically hold the drawer-like supporting structure in an intermediate position between the retracted position and the completely extracted position, and is furthermore unable to hold the drawer-like supporting structure stationary in said intermediate position; the flip-flop locking mechanism being also able to freely switch from one operating configuration to the other due to an external thrust.

Preferably, though not necessarily, the laundry washing machine is furthermore characterized in that the manually-operated command device is structured to selectively act on the flip-flop locking mechanism so as to force the flip-flop locking mechanism to switch from the first to the second working configuration.

Preferably, though not necessarily, the laundry washing machine is furthermore characterized in that the manually-operated command device is located on the appliance control panel.

Preferably, though not necessarily, the laundry washing machine is furthermore characterized in that the manually-operated command device is a manually-operated push-bottom.

Preferably, though not necessarily, the laundry washing machine is furthermore characterized in that the drawer-like supporting structure is provided with a handle portion which is arranged/located on the drawer-like supporting structure so as to remain inaccessible to the user when the drawer-like supporting structure is arranged in the retracted position, and to be easily accessible to the user when the drawer-like supporting structure is arranged away from the retracted position.

Preferably, though not necessarily, the laundry washing machine is furthermore characterized in that the detergent dispensing assembly comprises a single-dose detergent dispenser which is structured for selectively feeding into the washing tub a manually pre-loaded amount of detergent, softener and/or other washing agent sufficient for performing only a single washing cycle; and/or an autodosing detergent dispenser which is structured for automatically batching/dosing, on the basis of the selected washing cycle, the suitable amount/dose of detergent, softener and/or other washing agent to be used during the selected washing cycle and afterwards feeding said amount/dose of detergent, softener and/or other washing agent into the washing tub.

Preferably, though not necessarily, the laundry washing machine is furthermore characterized in that the detergent dispensing assembly is at least partially located/incorporated on the drawer-like supporting structure.

Preferably, though not necessarily, the laundry washing machine is furthermore characterized in that the single-dose detergent dispenser comprises a detergent drawer which is manually fillable with a quantity of detergent, softener and/or other washing agent sufficient for performing a single washing cycle, and which is fitted/inserted in manually extractable manner into a corresponding drawer housing which extends inside the casing underneath the upper worktop or top wall of the casing, and communicates with the outside via a front entrance or opening which is realized on the front wall of the casing above the laundry loading/unloading opening and horizontally beside the front entrance or opening of the drawer housing of the drawer-like supporting structure.

Preferably, though not necessarily, the laundry washing machine is furthermore characterized in that the single-dose detergent dispenser is at least partially located/incorporated on the drawer-like supporting structure.

Preferably, though not necessarily, the laundry washing machine is furthermore characterized in that the autodosing detergent dispenser is at least partially located/incorporated on the drawer-like supporting structure.

Preferably, though not necessarily, the laundry washing machine is furthermore characterized by also comprising an internal water softening device which is arranged/located inside the casing, along the fresh-water supply circuit, and is structured for reducing the hardness degree of the fresh water channeled to the detergent dispensing assembly and/or the washing tub; said water softening device preferably comprising: a water-softening agent container which is arranged/located along said fresh-water supply circuit so as to be crossed by the fresh water flowing towards the detergent dispensing assembly and/or directly to the washing tub, and is filled with a water softening agent able to reduce the hardness degree of the fresh water flowing through the same water-softening agent container; and a regeneration-agent reservoir which is located/incorporated into the drawer-like supporting structure, is structured for receiving a given quantity of consumable salt or other regeneration agent able to regenerate the water softening function of the water softening agents stored inside the water-softening agent container, and is fluidically connected to the water-softening agent container for selectively transferring a mixture of water and salt or other regeneration agent to the water-softening agent container.

Preferably, though not necessarily, the laundry washing machine is furthermore characterized in that the supporting structure is provided with one or more storage compartments which become accessible to the user when the drawer-like supporting structure is in the extracted position; preferably one storage compartment also housing a hand-held, substantially pen-shaped, ultrasonic garment stain-removal tool.

BRIEF DESCRIPTION OF THE DRAWINGS

A non-limiting embodiment of the present invention will now be described, by way of example, with reference to the accompanying drawings, in which:

FIGS. 6 and 7 are two partially-sectioned perspective views of the detergent drawer assembly of the FIG. 1 laundry washing machine in two different operative positions; whereas

DETAILED DESCRIPTION OF EXAMPLE EMBODIMENTS

Figure 1:
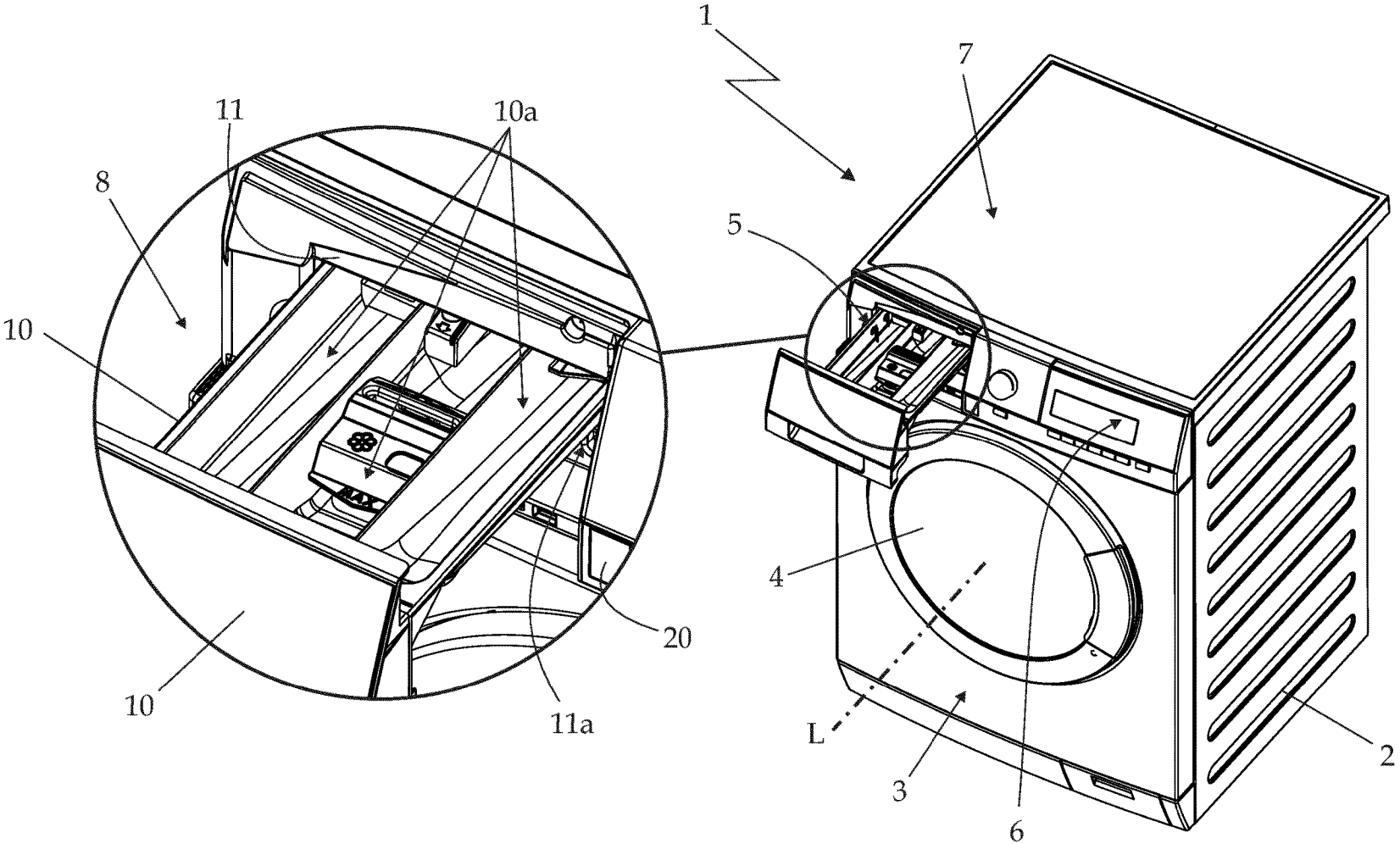
FIG. 1 is a perspective view of a front-loading, home laundry washing machine realized in accordance with the teachings of the present invention.
Figure 2:
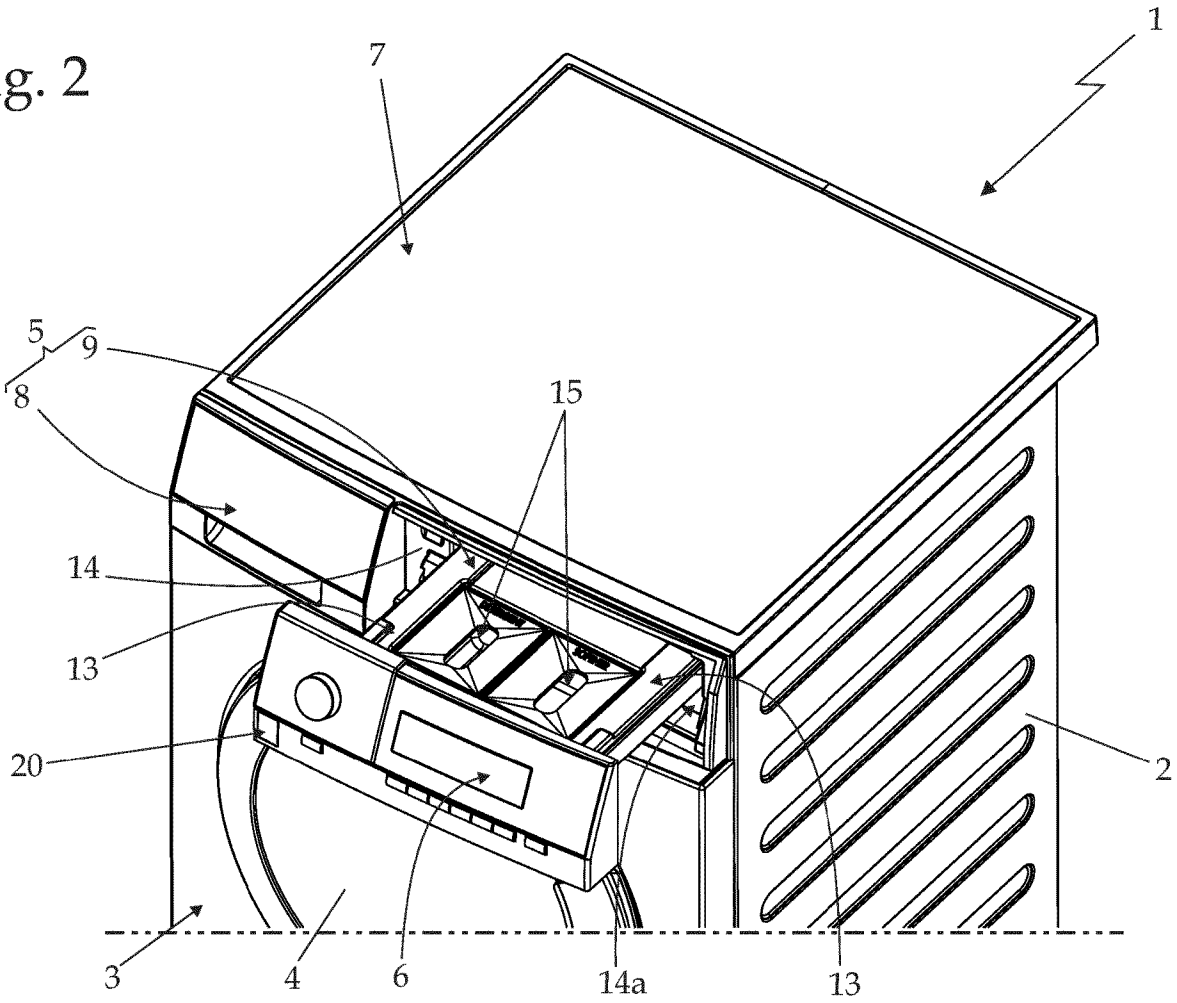
FIG. 2 is a perspective view of the FIG. 1 laundry washing machine in a different working configuration.

With reference to FIGS. 1 and 2, reference number 1 indicates as a whole a front-loading home laundry washing machine which comprises: a preferably, though not necessarily, substantially parallelepiped-shaped, rigid outer boxlike casing 2 which is structured for resting on the floor; a preferably substantially cylindrical, bell-shaped hollow washing tub (not shown) which is arranged inside the casing 2 with its opening or mouth directly facing a laundry loading/unloading through an opening realized in the front wall 3 of boxlike casing 2; and a substantially cylindrical, bell-shaped rotatable drum (not shown) which is structured for housing the laundry to be washed, and is housed in axially rotatable manner inside the washing tub so as to be able to freely rotate about its longitudinal reference axis.

In the example shown, in particular, the laundry loading/unloading opening is preferably realized on the front wall 3 of casing 2 substantially astride of the vertical center-plane of the casing 2, and the front opening or mouth of the washing tub (not shown) is preferably watertight connected to the laundry loading/unloading opening realized on front wall 3 by means of a preferably substantially cylindrical, connecting bellows (not shown) preferably having an elastically-deformable structure.

Furthermore the washing tub (not shown) is preferably suspended in floating manner inside the casing 2 and is preferably arranged inside the boxlike casing 2 with its longitudinal reference axis L substantially horizontally-oriented, i.e. substantially perpendicular to front wall 3.

The rotatable drum (not shown), in turn, is housed in axially rotating manner inside the washing tub (not shown) with its front opening directly faced/aligned to the laundry loading/unloading opening on front wall 3, and the drum rotation axis is preferably arranged locally substantially coincident with the horizontally-oriented longitudinal reference axis L of the washing tub.

With reference to FIGS. 1 and 2, the front-loading laundry washing machine 1 furthermore comprises:

- a porthole door 4 which is hinged to the front wall 3 of casing 2 to rotate about a preferably, though not necessarily, vertically-oriented reference axis to and from a closing position in which the peripheral border of the porthole door 4 rests completely on front wall 3 for closing the laundry loading/unloading opening and watertight sealing the washing tub (not shown);
- an electrically-powered motor assembly (not shown) which is housed inside the casing 2 and is structured for driving into rotation the rotatable drum (not shown) about its longitudinal reference axis inside the washing tub;
- a detergent dispensing assembly 5 which is housed inside the casing 2 in easily reachable manner by the user, and is structured for selectively feeding into the washing tub (not shown), according to the selected washing cycle, a given amount of detergent, softener and/or other washing agent preferably suitably mixed with the fresh water arriving from the water mains; and
- a main fresh-water supply circuit (not shown) which is structured for being connected to the water mains and for selectively channelling a flow of fresh water from the water mains to the detergent dispensing assembly 5 and/or directly to the washing tub (not shown), preferably while controlling/regulating the flowrate of fresh water towards the detergent dispensing assembly 5 and/or the washing tub.

Finally, the laundry washing machine 1 comprises an appliance control panel 6 which is structured for allowing the user to manually select the desired washing-cycle, and which is located on front wall 3 of casing 2, above the laundry loading/unloading opening and substantially immediately beneath the preferably substantially horizontally oriented, upper worktop or top wall 7 of the same casing 2.

The detergent dispensing assembly 5, in turn, preferably comprises: a single-dose detergent dispenser 8 which is housed inside the casing 2 above the washing tub (not shown), i.e. between the upper worktop 7 of casing 2 and the washing tub (not shown), and is structured for selectively feeding into the beneath located washing tub (not shown) a manually measured and pre-loaded amount of detergent, softener and/or other washing agent sufficient for performing only a single washing cycle; and a fully automatic, autodosing detergent dispenser 9 which is housed inside the casing 2 preferably horizontally beside the single-dose detergent dispenser 8, and is structured for automatically batching/dosing, on the basis of the selected washing cycle, the suitable amount/dose of detergent, softener and/or other washing agent to be used during the selected washing cycle and which is afterwards fed into the washing tub.

With reference to FIGS. 1, 2, 3, and 4, in the example shown, in particular, the single-dose detergent dispenser 8 preferably comprises a detergent drawer 10 which is manually fillable with a quantity of detergent, softener and/or other washing agent sufficient for performing a single washing cycle, and which is fitted/inserted in manually extractable manner into a corresponding, completely recessed, drawer housing 11 which extends preferably substantially horizontally inside the boxlike casing 2 while remaining beneath the upper worktop or top wall 7 and above the washing tub (not shown), and moreover communicates with the outside of casing 2 via a front entrance or opening 11*a* which is realized on front wall 3 of casing 2 above the laundry loading/unloading opening and underneath the upper worktop or top wall 7 of the casing 2.

In the example shown, in particular, the drawer housing 11 is preferably completely recessed inside the casing 2, immediately beneath the worktop or top wall 7 of casing 2, so as to locate its front entrance or opening 11*a* on front wall 3 immediately beneath the front side edge of the upper worktop or top wall 7 of casing 2.

The detergent drawer 10, in turn, is preferably movable inside the drawer housing 11 along a preferably substantially horizontally-oriented, displacement direction between a retracted position (see FIG. 2) in which the detergent drawer 10 is completely recessed inside the drawer housing 11, i.e. inside the casing 2, preferably while at same time closing the front entrance or opening 11*a* of the drawer housing 11; and a completely extracted position (see FIG. 1) in which the detergent drawer 10 partly juts out from the front wall 3 of casing 2 through the front entrance or opening 11*a* of the drawer housing 11 so as to allow easy manual refilling of the same detergent drawer 10.

In addition to the above, the detergent drawer 10 is preferably movable inside the drawer housing 11 along a substantially horizontally-oriented, displacement direction which is locally substantially perpendicular to the front wall 3 of casing 2.

Preferably the drawer housing 11 also has a substantially basin-shaped bottom portion (not shown) which directly communicates with the inside of the beneath located washing tub via a suitable connecting duct (not shown), and the single-dose detergent dispenser 8 preferably additionally comprises a water supply circuit (not shown) which is connected to the main fresh-water supply circuit, and is structured for selectively channelling/pouring, when the detergent drawer 10 is in the retracted position, a given amount of fresh water arriving from the water mains directly into the detergent drawer 10, so as to selectively flush/push the detergent, softener or other washing agent out of detergent drawer 10 and down on the bottom of the drawer housing 11. This mixture of water and detergent, softener or other washing agent afterwards flows into the washing tub via the connecting duct (not shown) branching off from the basin-shaped bottom of drawer housing 11.

With reference to FIG. 1, in the example shown, in particular, the detergent drawer 10 is preferably divided into a number/plurality of detergent compartments 10*a* (three detergent compartments in the example shown) each of which is manually fillable with a respective given quantity of detergent, softener or other washing agent sufficient for performing a single washing cycle; and the water supply circuit of the single-dose detergent dispenser 8 is preferably structured for spilling/pouring the fresh water arriving from the main fresh-water supply circuit (not shown) selectively and alternatively into any one of the detergent compartments 10*a* of detergent drawer 10, so as to selectively flush the detergent, softener or other washing agent out of the same detergent compartment 10*a* and down onto the bottom of drawer housing 11.

More in particular, in the example shown the water supply circuit of the single-dose detergent dispenser 8 is preferably structured for selectively spilling/pouring a dense shower of water droplets by gravity directly into any one of the detergent compartments 10*a* of detergent drawer 10, so as to flush the detergent, softener or other washing agent out of the detergent comportment 10*a* and down onto the bottom of drawer housing 11.

With reference to FIGS. 1, 2, 3, 4 and 5, the laundry washing machine 1 is additionally provided with a drawer-like supporting structure 13 which is fitted/inserted in extractable manner into a corresponding, completely recessed, drawer housing 14 which extends preferably substantially horizontally inside the boxlike casing 2 while remaining beneath the upper worktop or top wall 7 and above the washing tub (not shown), and communicates with the outside of casing 2 via a front entrance or opening 14*a* which is realized on front wall 3 of casing 2 above the laundry loading/unloading opening and underneath the upper worktop or top wall 7 of casing 2. The appliance control panel 6 and the autodosing detergent dispenser 9 are both at least partially located/incorporated into this drawer-like supporting structure 13.

More in details, in the example shown, the front entrance or opening 14*a* of drawer housing 14 is preferably realized on front wall 3 of casing 2 horizontally beside the front entrance or opening 11*a* of drawer housing 11.

In other words, the drawer housing 14 is preferably completely recessed inside the casing 2, immediately beneath the worktop or top wall 7 of casing 2, so as to locate its front entrance or opening 14*a* on the front wall 3 of casing 2, immediately beneath the front side edge of the upper worktop or top wall 7 of casing 2 and beside the front entrance or opening 11*a* of drawer housing 11.

In the example shown, in particular, the drawer housing 11 of the single-dose detergent dispenser 8 is preferably arranged inside the boxlike casing 2 so as to locate its front entrance or opening 11*a* immediately beneath the worktop or top wall 7 of casing 2, approximately at the upper left corner of front wall 3; whereas the drawer housing 14 of the autodosing detergent dispenser 9 is preferably arranged inside the boxlike casing 2 so as to locate its front entrance or opening 14*a* immediately beneath the worktop or top wall 7 of casing 2 and beside the front entrance or opening 11*a* of drawer housing 11, approximately at the upper right corner of front wall 3.

Preferably the front entrance or opening 14*a* of drawer housing 14 is moreover immediately adjacent to the front entrance or opening 11*a* of drawer housing 11 and extends beneath the worktop or top wall 7 of casing 2, from the front entrance or opening 11*a* of drawer housing 11 substantially up to the right sidewall of the same casing 2, i.e. beneath the remaining portion of the front side edge of the upper worktop or top wall 7 of casing 2.

With reference to FIGS. 1, 2, 3, 4 and 5, the appliance control panel 6 is at least partially, and preferably entirely, located/arranged on a front side of the drawer-like supporting structure 13, and the drawer-like supporting structure 13 is movable inside the drawer housing 14 along a preferably substantially horizontally-oriented, displacement direction d between

- a retracted position (see FIG. 1) in which the drawer-like supporting structure 13 is completely inserted into the drawer housing 14, i.e. completely recessed inside the casing 2, and arranges the appliance control panel 6 substantially coplanar to the front wall 3 of casing 2, substantially at closure of the front entrance or opening 14*a* of the drawer housing 14; and
- a completely extracted position (see FIG. 2) in which the drawer-like supporting structure 13 partly juts out from the front wall 3 of casing 2 through the front entrance or opening 14*a* of the drawer housing 14 so as arrange the appliance control panel 6 forward spaced apart from the front wall 3 of casing 2 at maximum distance from front wall 3.

In the example shown, in particular, the drawer-like supporting structure 13 is preferably movable inside the drawer housing 14 along a substantially horizontally-oriented, displacement direction d which is locally substantially perpendicular to front wall 3 of casing 2, and is therefore locally substantially parallel to the displacement direction of the detergent drawer 10 of the single-dose detergent dispenser 8.

Furthermore the drawer-like supporting structure 13 is preferably, though not necessarily, also provided with a handle portion (such as, for example, the back face of the front side of drawer-like supporting structure 13 that carries the appliance control panel 6) which is arranged/located on the drawer-like supporting structure 13 so as to remain completely hidden/recessed inside the casing 2 or the drawer housing 14, and therefore inaccessible to the user, when the drawer-like supporting structure 13 is in the retracted position, and to be easily accessible to the user when the drawer-like supporting structure 13 is arranged away from the retracted position.

In other words, preferably, for aesthetical reasons, the appliance control panel 6 lacks a handle portion.

Figure 3:
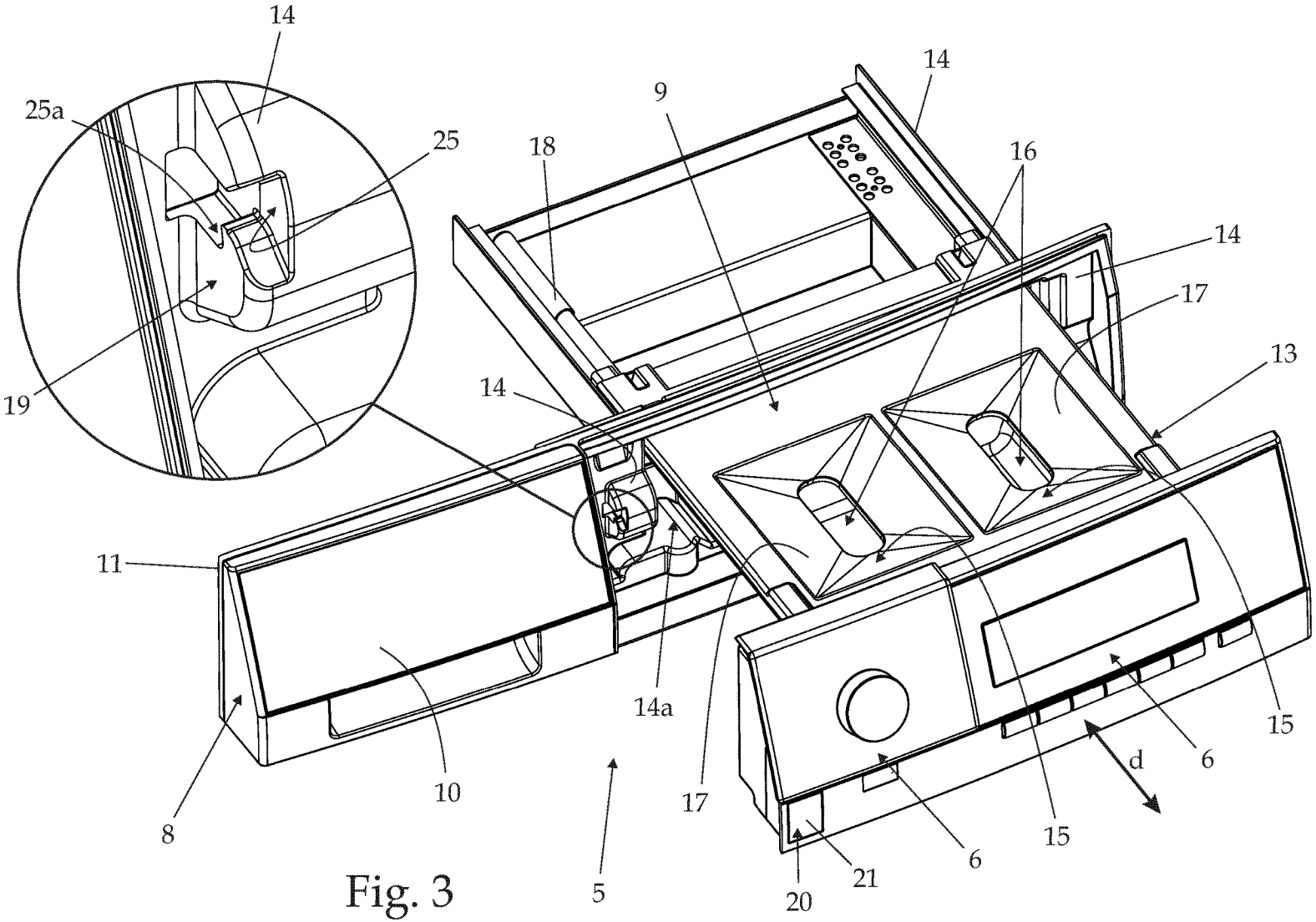
FIGS. 3, 4 and 5 are three perspective views of the upper portion of the FIG. 1 laundry washing machine with parts in section and parts removed for clarity.

With reference to FIGS. 1, 2 and 3, the autodosing detergent dispenser 9, in turn, preferably comprises one or more detergent reservoirs 15 each of which is structured for receiving a great quantity (for example half a liter or one liter) of detergent, softener and/or other washing agent sufficient for performing a great number of washing cycles, and is arranged/located on the drawer-like supporting structure 13 so as to allow the user to easily load the detergent, softener and/or other washing agent into the same detergent reservoir 15 when the drawer-like supporting structure 13 is arranged in the completely extracted position.

In other words, the drawer-like supporting structure 13 is movable in a preferably substantially horizontally-oriented, displacement direction d between

- a retracted position (see FIG. 1) in which the drawer-like supporting structure 13 is completely recessed/inserted into the drawer housing 14, so as to place/close the one or more detergent reservoirs 15 inside the casing 2 for hiding them to the user, i.e. for making them inaccessible to the user, and so as to arrange at same time the control panel 6 substantially coplanar to the front wall 3 of casing 2, at closure of the front entrance or opening 14*a* of the drawer housing 14; and
- a completely extracted position (see FIGS. 2 and 3) in which the drawer-like supporting structure 13 partly juts out from the front wall 3 of casing 2, so as to place/arrange the loading inlets or mouths of the one or more detergent reservoirs 15 completely outside of the casing 2 to make said loading inlets or mouths easy accessible to the user, and so as to arrange at same time the appliance control panel 6 forward spaced apart from the front wall 3 of casing 2 at maximum distance from front wall 3.

With reference to FIGS. 2 and 3, in the example shown, in particular, the autodosing detergent dispenser 9 is preferably provided with two detergent reservoirs 15 which are structured for storing, respectively, a great quantity (for example one liter) of detergent, and a great quantity (for example half a liter) of softener or other washing agent.

Preferably each detergent reservoir 15 additionally comprises in a preferably substantially rectangular, basin-shaped container 16 which is formed/incorporated directly on the drawer-like supporting structure 13, so that its upper opening or mouth is freely accessible by the user when the drawer-like supporting structure 13 is arranged in the extracted position (see FIGS. 2 and 3), and is completely hidden and inaccessible by the user when the drawer-like supporting structure 13 is arranged in the retracted position (see FIG. 1). Moreover each detergent reservoir 15 preferably also comprises a preferably funnel-shaped upper lid 17 which is fitted into the basin-shaped container 16 in rigid and preferably also manually removable manner, at closure of the upper opening or mouth of the basin-shaped container 16.

In addition to the above, the autodosing detergent dispenser 9 furthermore comprises one or more electrically-powered detergent feeding pumps (not shown) each of which is preferably structured for selectively sucking, from a corresponding detergent reservoir 15, the specific amount of the detergent, softener or other washing agent necessary and sufficient for performing the selected washing cycle, and pumping/channelling said specific amount of the detergent, softener or other washing agent towards the washing tub.

More in particular, each detergent feeding pump (not shown) is preferably structured for selectively sucking a sequence of one or more basic amounts of detergent, softener or other washing agent from a corresponding detergent reservoir 15 and pumping/channelling said sequence of one or more basic amounts of detergent, softener or other washing agent towards the connecting duct (not shown) that connects the drawer housing 11 of the single-dose detergent dispenser 8 to the washing tub (not shown). The sequence of one or more basic amounts of detergent or other washing agent forms the specific amount of the detergent or other washing agent necessary and sufficient for performing the selected washing cycle.

With reference to FIGS. 3, 4, 5, 6 and 7, in addition to the drawer-like supporting structure 13, the laundry washing machine 1 furthermore comprises:

- a push member 18 which is structured so as to elastically push the drawer-like supporting structure 13 away from the retracted position (see FIG. 1) and towards the completely extracted position;

a locking mechanism 19 which is structured to selectively hold the drawer-like supporting structure 13 in the retracted position and prevent the push member 18 from pushing the drawer-like supporting structure 13 away from the retracted position; and finally a manually-operated command device 20 which is structured so as to force, when manually operated, the locking mechanism 19 to release the drawer-like supporting structure 13, thus allowing the push member 18 to push the drawer-like supporting structure 13 away from the retracted position.

More in detail, in the example shown the manually-operated command device 20 is preferably located on front side of the drawer-like supporting structure 13, i.e. on the appliance control panel 6.

In the example shown, furthermore, the push member 18 is preferably structured to elastically push the drawer-like supporting structure 13 away from the retracted position into of a few millimeters, up to place the drawer-like supporting structure 13 in an intermediate position between the retracted and the completely extracted position.

Obviously, in an alternative embodiment the push member 18 could also be structured to elastically push the drawer-like supporting structure 13 away from the retracted position and up to the completely extracted position.

The locking mechanism 19 instead is preferably at least partially arranged on the drawer-like supporting structure 13, and is preferably structured to automatically rigidly hook/hitch/lock, when the drawer-like supporting structure 13 is arranged in the retracted position, the drawer-like supporting structure 13 to the drawer housing 14 so as to prevent any further movement of the drawer-like supporting structure 13 with respect to the drawer housing 14.

The manually-operated command device 20, in turn, is structured so as to force, when manually operated by the user, the locking mechanism 19 to release the drawer-like supporting structure 13 from the drawer housing 14, thus allowing the push member 18 to push the drawer-like supporting structure 13 away from the retracted position.

More specifically, the manually-operated command device 20 preferably comprises a manually-operated push-bottom 21 which is located on the appliance control panel 9 and is structured so as to force, when pushed by the user, the locking mechanism 19 to release the drawer-like supporting structure 13 from the drawer housing 14, thus allowing the push member 18 to push the drawer-like supporting structure 13 away from the retracted position.

Figure 4:
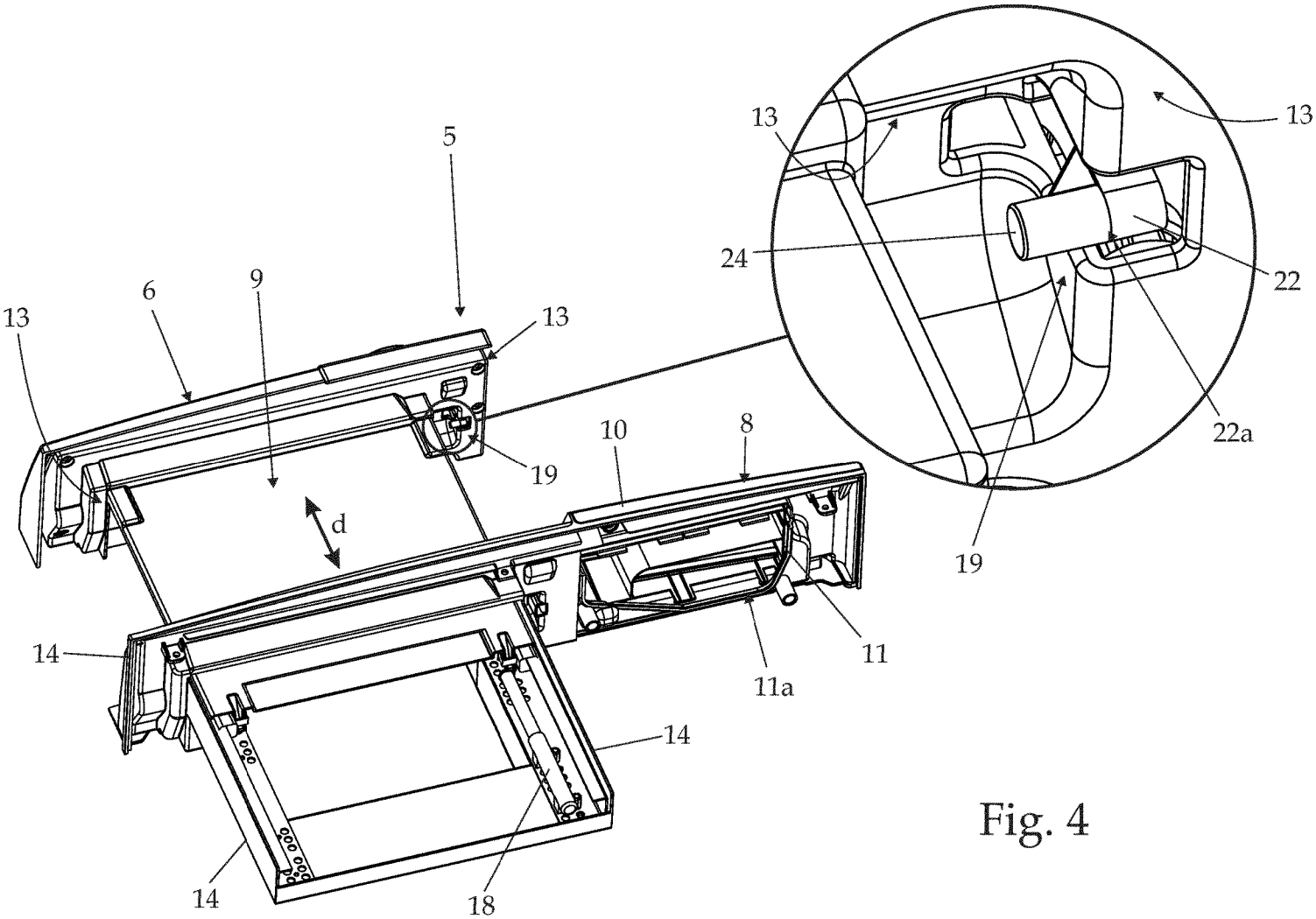

With reference to FIGS. 3 and 4, in the example shown, in particular, the push member 18 is preferably a rod-like spring plunger 18 which is arranged inside the drawer housing 14 substantially parallel to the displacement direction d, with the outer tubular sleeve rigidly connected to the drawer housing 14 and with the distal end of the inner actuating rot in abutment on the drawer-like supporting structure 13, so a s to be able to elastically push the drawer-like supporting structure 13 away from the retracted position and preferably up to an intermediate position between the retracted and the completely extracted positions, parallel to the displacement direction d of the drawer-like supporting structure 13.

With reference to FIGS. 3 to 7, the locking mechanism 19, in turn, is preferably at least partially arranged on the front side of the drawer-like supporting structure 13, behind the appliance control panel 6, and comprises a catch member 22 which protrudes backwards from the front side of the drawer-like supporting structure 13 substantially towards the front entrance or opening 14*a* of the drawer housing 14, preferably while remaining locally substantially parallel to the displacement direction d of the drawer-like supporting structure 13.

The distal end 22*a* of catch member 22 is structured so as to be able, when the drawer-like supporting structure 13 is arranged in the retracted position, to reach and firmly hook/hitch/engage in a stable, though easily releasable manner onto a corresponding engagement portion of the front section or dashboard of the drawer housing 14 that surrounds/forms the front entrance or opening 14*a* of the drawer housing 14, so as to rigidly connect the drawer-like supporting structure 13 to the drawer housing 14, i.e. so as to prevent any movement of the drawer-like supporting structure 13 with respect to the drawer housing 14.

The catch member 22 is furthermore movable between a locking position wherein the distal end 22*a* of the catch member 22 is able to firmly hook/hitch onto the drawer housing 14, and an unlocking position wherein the distal end 22*a* of the catch member 22 is unable to firmly hitch/hook onto the drawer housing 14 and is therefore forced to release the drawer housing 14; and the manually-operated push-bottom 21 is structured to selectively move, when pushed by the user, the catch member 22 from the locking position to the unlocking position, so as to force the catch member 22 to release the front section or dashboard of the drawer housing 14.

Preferably the locking mechanism 19 furthermore comprises an elastic member 23 which is preferably located on the drawer-like supporting structure 13, and is structured to elastically keep/hold the catch member 22 in the locking position, so as to allow the catch member 22 to automatically firmly hook/hitch onto the drawer housing 14 when the drawer-like supporting structure 13 is arranged in the retracted position.

With reference to FIGS. 3, 4, 5, 6 and 7, in the example shown, in particular, the catch member 22 preferably comprises a preferably substantially L-shaped rocker arm 22 which is pivotally jointed, at the bend, to the drawer-like supporting structure 13 so as to be able to freely swing about a rotation axis C which is preferably substantially perpendicular to the displacement direction d of the drawer-like supporting structure 13 and preferably also substantially horizontal.

The rocker arm 22 is moreover arranged on the drawer-like supporting structure 13 so that the upper straight section of the L-shaped rocker arm 22 extends cantilevered from the back of the front side of the drawer-like supporting structure 13 towards the front entrance or opening 14*a* of the drawer housing 14, preferably while remaining locally substantially parallel to the displacement direction d of the drawer-like supporting structure 13; and the distal end of the upper section of the L-shaped rocker arm 22 is structured to be able to firmly hook, when the drawer-like supporting structure 13 is arranged in the retracted position, onto a corresponding engagement portion of the front section or dashboard of the drawer housing 14 in a stable, though easily releasable manner, so as to rigidly connect the drawer-like supporting structure 13 to the drawer housing 14.

The distal end of the upper section of the L-shaped rocker arm 22 therefore forms the distal end 22*a* of catch member 22.

The elastic member 23, in turn, acts on the L-shaped rocker arm 22 so as to elastically keep/hold the upper section of the substantially L-shaped rocker arm 22 in a rest position suitable to allow the distal end of the same upper section of the rocker arm 22 to firmly hook/hitch onto the drawer housing 14.

In other words, the elastic member 23 acts on the L-shaped rocker arm 22 so as to elastically keep/hold the upper section of the substantially L-shaped rocker arm 22 in a locking position wherein the distal end of the same upper section of the rocker arm 22 is allowed to firmly hook/hitch onto the drawer housing 14.

Figure 5:
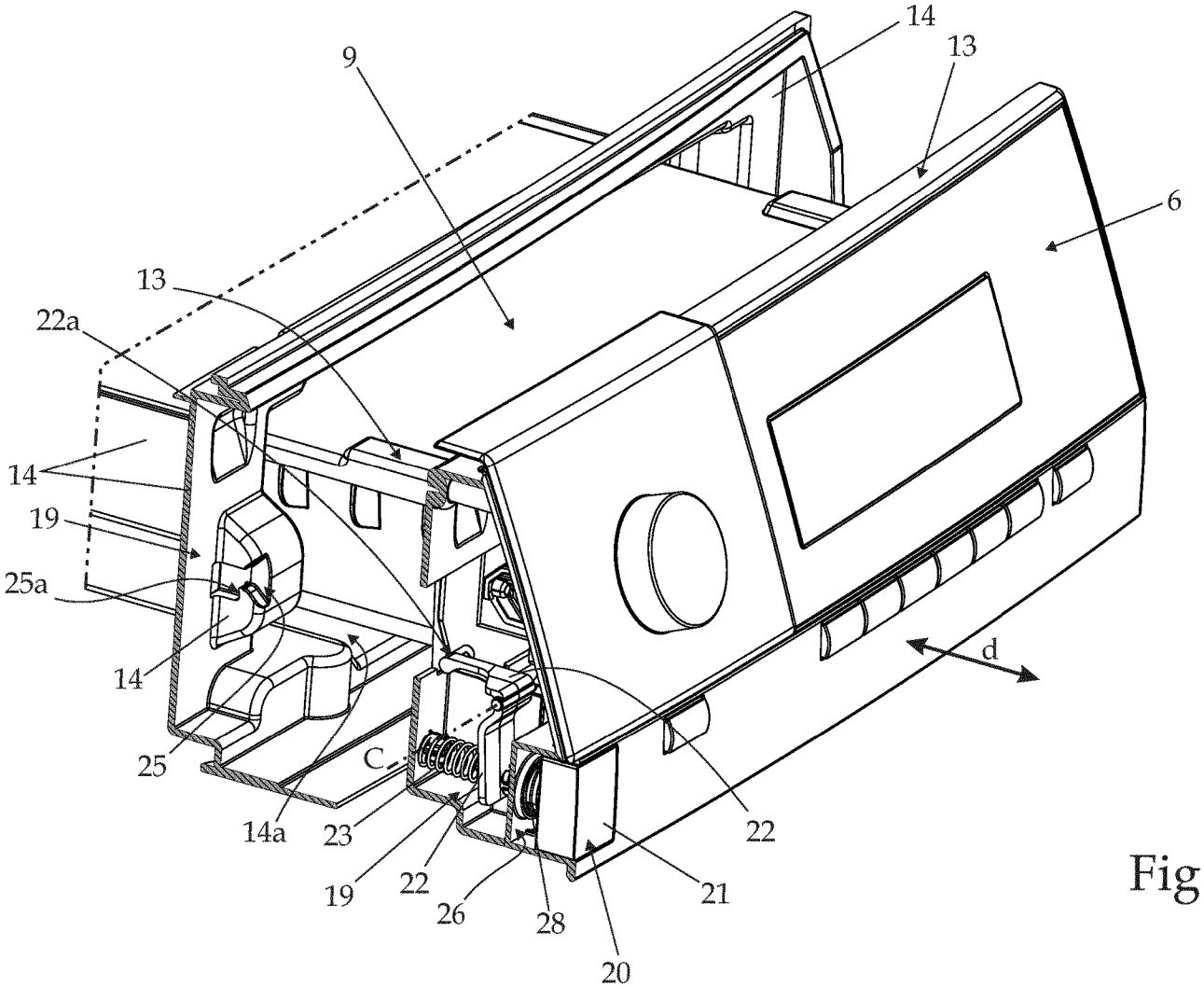
Figure 6:
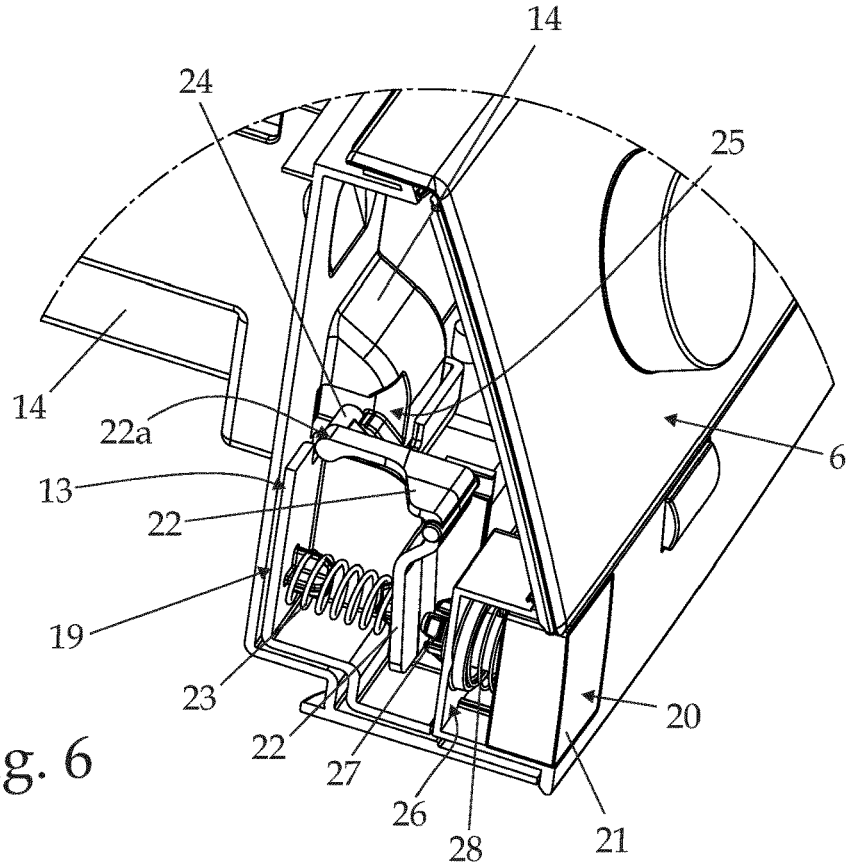
Figure 7:
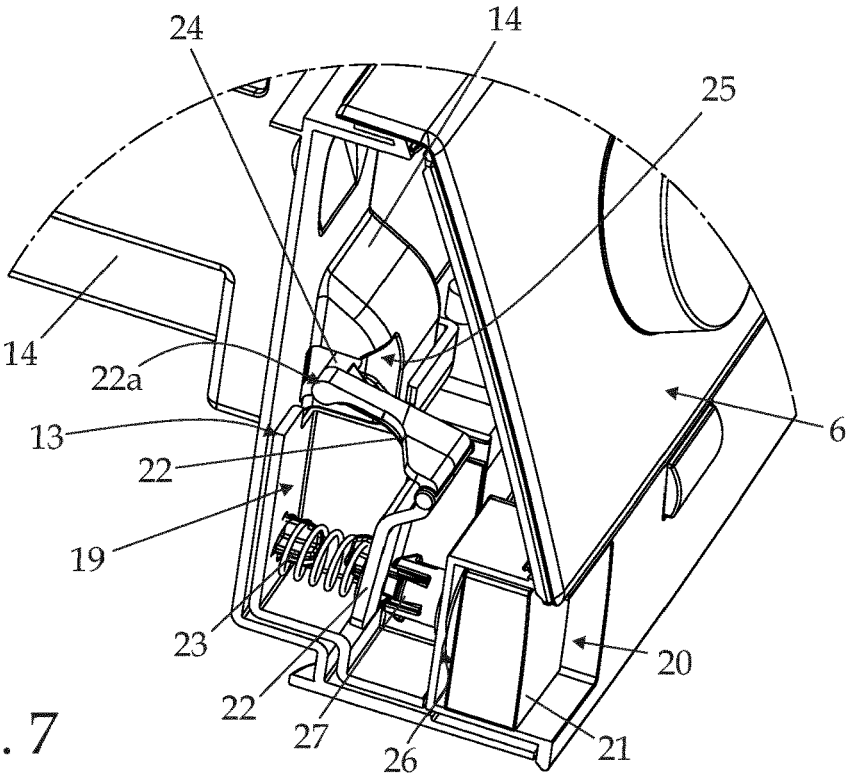

With reference to FIGS. 5, 6 and 7, in the example shown, in particular, the elastic member 23 preferably acts on the lower straight section of the L-shaped rocker arm 22 so as to keep/hold the upper section of the L-shaped rocker arm 22 in the rest/locking position.

The manually-operated push-bottom 21, in turn, is located on the front side of the drawer-like supporting structure 13, i.e. on the appliance control panel 6, and is structured to act on the L-shaped rocker arm 22 so to selectively tilt/rotate the rocker arm 22 of a few degrees about rotation axis C, so as to move the upper section of the L-shaped rocker arm 22 from the rest/locking position wherein the distal end 22*a* of the upper section of the L-shaped rocker arm 22 is able to firmly hook onto the front section or dashboard of the drawer housing 14, to an unlocking position wherein the distal end 22*a* of the upper section of the L-shaped rocker arm 22 is unable to firmly hook onto the front section or dashboard of the drawer housing 14 and is therefore forced to release the drawer housing 14.

In the example shown, in particular, the manually-operated push-bottom 21 is located on the front side of the drawer-like supporting structure 13, i.e. on the appliance control panel 6, so as to be locally substantially aligned to the lower straight section of the substantially L-shaped rocker arm 22, and is structured so to be able to act, when pushed, on the lower section of rocker arm 22 to cause a small rotation of the rocker arm 22 against the action of the elastic member 23, from the rest/locking position to the unlocking position.

More in details, with reference to FIGS. 4, 5, 6 and 7, in the example shown the distal end of the upper section of the L-shaped rocker arm 22 is preferably provided with a protruding pin 24 which cantilevered extends sideways from the upper section of the L-shaped rocker arm 22 while remaining locally substantially perpendicular to the swinging plane of the rocker arm 22, i.e. locally substantially parallel to rotation axis C, and is shaped so as to engage in sliding manner into a corresponding coupling groove 25 realized on the front section or dashboard of the drawer housing 14.

The coupling groove 25 extends on the drawer housing 14 while remaining locally substantially coplanar to the swinging plane of the rocker arm 22, and the front mouth of the coupling groove 25 is arranged on the front section or dashboard of the drawer housing 14 so as to the face the protruding pin 24, so that the protruding pin 24 is allowed to enter and afterwards freely slide along the whole coupling groove 25.

With particular reference to FIGS. 3 and 5, the coupling groove 25 is furthermore internally provided with a stop notch 25*a* which is shaped so to receive the protruding pin 24 and to prevent any further movement of the protruding pin 24 parallel to the displacement direction d of the drawer-like supporting structure 13. Thus, when the protruding pin 24 engages the stop notch of the coupling groove 25, the rocker arm 22 is prevented from moving parallel to the displacement direction d of the drawer-like supporting structure 13 and is therefore able to rigidly connect the drawer-like supporting structure 13 to the drawer housing 14.

The elastic member 23, in turn, acts on the rocker arm 22 so as to elastically keep/hold the protruding pin 24 of rocker arm 22 locally substantially aligned to the front mouth of the coupling groove 25 in the rest position, so that the protruding pin 24, when the drawer-like supporting structure 13 moves along displacement direction d, is allowed to enter in the coupling groove 25 and then slide along the coupling groove 25 up to reach and engage the stop notch. Any rotation of the rocker arm 22 away from the rest position forces the protruding pin 24 to jump out from the stop notch of the coupling groove 25, and slide along the coupling groove 25 back to the mouth of the coupling groove 25.

More in particular, in the example shown the elastic member 23 preferably acts on the lower section of the L-shaped rocker arm 22 so as to elastically keep/hold the upper section of the L-shaped rocker arm 22 locally substantially parallel to the displacement direction d of the drawer-like supporting structure 13.

With reference to FIGS. 5, 6 and 7, the manually-operated push-bottom 21 in turn is preferably fitted/recessed in axially sliding manner into a substantially cup-shaped, recessed seat 26 which is incorporated into the appliance control panel 6, i.e. is located on the front side of the drawer-like supporting structure 13, so as to be aligned to the lower straight section of the L-shaped rocker arm 22. The push-bottom 21 is thus movable inside the recessed seat 26 between a forward position (see FIG. 6) wherein the push-bottom 21 is located substantially at mouth of the cup-shaped, recessed seat 26 so as to substantially surface or crop out from the front side of the drawer-like supporting structure 13, and a rearward position (see FIG. 7) wherein the push-bottom 21 is located substantially at bottom of the substantially cup-shaped, recessed seat 26.

The push-bottom 21 is furthermore provided with a rigid rear stem 27 which protrudes from the back of the same push-bottom 21, engages in pass-through and axially sliding manner a corresponding pass-though hole realized on the bottom of the recessed seat 26, and finally abuts on the lower section of the L-shaped rocker arm 22.

The stroke of the manually-operated push-bottom 21 and the rigid stem 27 are specifically dimensioned so that the rigid stem 27 is able, when the push-bottom 21 moves from the forward to the rearward position, of rotating/tilting of a few degrees the rocker arm 22 against the action of the elastic member 23, so as to move the upper section of the L-shaped rocker arm 22 from the rest/locking position (see FIGS. 5 and 6) wherein the protruding pin 24 of rocker arm 22 is locally substantially aligned to the mouth of the coupling groove 25 and can slide along the coupling groove 25 up to reach and engage into the stop notch, to the unlocking position (see FIG. 7) wherein the protruding pin 24 of rocker arm 22 is forced to disengage from the stop notch of the coupling groove 25 and to freely slide along the coupling groove 25 back to the mouth of the same coupling groove 25.

The elastic member 23, in turn, preferably includes a coil spring 23 or the like which is arranged substantially coaxial to the rigid stem 27 of the manually-operated push-bottom 21, on the other side of the lower straight section of the L-shaped rocker arm 22 with respect to rigid stem 27, so as to have a first end in abutment on the drawer-like supporting structure 13 and a second end in abutment on the lower straight section of the L-shaped rocker arm 22.

The coil spring 23 is furthermore suitably structured so as to elastically keep/hold the upper section of the L-shaped rocker arm 22 locally substantially parallel to the displacement direction d of the drawer-like supporting structure 13, and to elastically hinder any axial displacement of the rigid stem 27 that would cause the movement of the L-shaped rocker arm 22 from the rest/locking position to the unlocking position.

With reference to FIGS. 5, 6 and 7, the appliance control panel 6 preferably also comprises a further elastic member 28 which is structured to elastically keep/hold the manually-operated push-bottom 21 in the forward position (see FIGS. 5 and 6) so as to leave the L-shaped rocker arm 22 in the rest/locking position.

More in particular, in the example shown the elastic member 28 is preferably a coil spring 28 or the like which is fitted on the rigid stem 27 of push-bottom 21 so as to have a first end in abutment on the bottom of the substantially cup-shaped, recessed seat 26 and a second end in abutment on the back of the push-bottom 21. The coil spring 28 is suitably preloaded to elastically keep/hold the manually-operated push-bottom 21 permanently in the forward position (see FIGS. 5 and 6) so as to leave the L-shaped rocker arm 22 in the rest/locking position.

General operation of the front-loading home laundry washing machine 1 is clearly inferable from the above description: the electronic central control unit of laundry washing machine 1, according to the selected washing cycle, can use either the single-dose detergent dispenser 8 or the fully autodosing detergent dispenser 9, or even both devices, to selectively feed into the washing tub (not shown) the detergent, softener and/or other washing agent necessary to perform the washing cycle.

As regards the drawer-like supporting structure 13, the front side of the drawer-like supporting structure 13 abuts on the front section or dashboard of the drawer housing 14 that surrounds/forms the front entrance or opening 14*a* of the drawer housing 14, so as to remain substantially perfectly coplanar to the front wall 3 of casing 2, and the user is requested to simply push the manually-operated push-bottom 21 to have the drawer-like supporting structure 13 moved away from the retracted position.

The advantages resulting from having the push member 18, the locking mechanism 19 and the manually-operated push-bottom 21 are remarkable. When the drawer-like supporting structure 13 is in the retracted position, the front side of the drawer-like supporting structure 13 abuts on the front section or dashboard of the drawer housing 14, thus offering a more user-friendly feedback to the user that pushes any of the push-buttons located on the appliance control panel 6.

Furthermore the appliance control panel 6 located on front side of the drawer-like supporting structure 13 remains stably perfectly coplanar to front wall 3 of casing 2 thus meeting major design requests.

Clearly, changes may be made to the front-loading laundry washing machine 1 as described above without, however, departing from the scope of the present invention.

For example, according to a less sophisticated non-shown embodiment of the laundry washing machine 1, the detergent dispensing assembly 5 may lack the single-dose detergent dispenser 8 and the drawer-like supporting structure 13 may preferably, though not necessarily, extend underneath the upper worktop or top wall 7 of the casing 2 substantially for the whole width of the front wall 3 of the casing 2.

According to a further non-shown embodiment, the single-dose detergent dispenser 8 may be also incorporated into the drawer-like supporting structure 13 together or even in place of/in alternative to the autodosing detergent dispenser 9.

According to a further non-shown embodiment, the drawer-like supporting structure 13 may have, in addition to or even in place of the autodosing detergent dispenser 9, one or more storage compartments which became accessible to the user when the drawer-like supporting structure 13 is arranged in the extracted position, and which are dimensioned for storing small washing agent containers, brushes and/or any other tools useful in laundry washing operations, such as, for example, a hand-held, substantially pen-shaped, ultrasonic garment stain-removal tool like the one disclosed in EP-1553161.

According to a more sophisticated further non-shown embodiment, the laundry washing machine 1 may additionally have an internal water softening device which is arranged/located inside the casing 2, along the main fresh-water supply circuit, and is structured for reducing the hardness degree of the fresh water channeled to the detergent dispensing assembly 5 and/or the washing tub.

This water softening device preferably comprises: a water-softening agent container which is arranged/located along the main fresh-water supply circuit so as to be crossed by the fresh water flowing towards the detergent dispensing assembly 5 and/or directly to the washing tub, and is filled with a water softening agent able to reduce the hardness degree of the fresh water flowing through the same water-softening agent container; and a regeneration-agent reservoir which is located/incorporated into the drawer-like supporting structure 13, is structured for receiving a given large quantity of consumable salt or other regeneration agent able to regenerate the water softening function of the water softening agents stored inside the water-softening agent container, and is fluidically connected to the water-softening agent container for selectively transferring a mixture of water and salt or other regeneration agent to the water-softening agent container.

Finally, with reference to FIGS. 8 to 11, according to a further different embodiment the laundry washing machine 1, the locking mechanism 19 is preferably structured to selectively elastically hold the drawer-like supporting structure 13 inside the drawer housing 14 in the retracted position, preferably while overcoming the thrust of push member 18.

More specifically the locking mechanism 19 is preferably a flip-flop locking mechanism 19 which is structured so as to be able to selectively and alternatively assume to two distinct operating configurations, and so as to be able to freely switch from one operating configuration to the other due to an external thrust.

In the first working configuration the flip-flop locking mechanism 19 elastically hold the drawer-like supporting structure 13 inside the drawer housing 14 in the retracted position, while overcoming the thrust of the push member 18.

In the second working configuration the flip-flop locking mechanism 19 elastically hold the drawer-like supporting structure 13 in an intermediate position between the retracted position and the completely extracted position, and is furthermore unable to hold the drawer-like supporting structure 13 stationary in said intermediate position thus allowing free movement of the drawer-like supporting structure 13 towards the completely extracted position. Furthermore in the second working configuration the locking mechanism 19 is unable to overcome the thrust of the push member 18, which is therefore allowed to further push the drawer-like supporting structure 13 away from the retracted position and towards the completely extracted position.

The manually-operated command device 20, in turn, is structured to selectively act on the flip-flop locking mechanism 19 so as to force the flip-flop locking mechanism 19 to switch from the first to the second working configuration.

In the example shown, in particular, the locking mechanism 19 is preferably located inside the drawer housing 14, close to the front entrance or opening 14*a*, and preferably comprises a rocker arm 30 which is located close to one of the two sliding runners 31 that connect the drawer-like supporting structure 13 to the drawer housing 14, and is pivotally jointed to the drawer housing 14 so as to be able to freely swing while remaining on a reference laying plane locally parallel to the displacement direction d of the drawer-like supporting structure 13 and while keeping a first end 30*a* of the rocker arm 30 locally substantially tangent to the corresponding sliding runner 31.

This first end 30*a* of the rocker arm 30, in turn, is substantially fork-shaped so as to be able to slidingly fork/engage a transversal pin 32 that sticks out from the drawer-like supporting structure 13 at the sliding runners 31.

The locking mechanism 19 furthermore comprises an elastic member 33, namely a coil spring, which is interposed between the rocker arm 30 and the drawer housing 14, and is structured so as to be able to elastically hold the rocker arm 30 selectively and alternatively in a first rest position (see FIG. 10) wherein the rocker arm 30 is tilted towards the back of the drawer housing 14 so as to arrange the first end 30*a* of the rocker arm 30 close to the back of the drawer housing 14, and the first end 30*a* of the rocker arm 30 forks/engages the transversal pin 32 so as to elastically hold the drawer-like supporting structure 13 completely inside the drawer housing 14 in the retracted position, while overcoming the thrust of the push member 18; and in a second rest position (see FIGS. 9 and 11) wherein the rocker arm 30 is tilted towards the front entrance or opening 14*a* of the drawer housing 14 so as to arrange the first end 30*a* of the rocker arm 30 close to the front entrance or opening 14*a*, and the first end 30*a* of the rocker arm 30 forks/engages the transversal pin 32 so as to arrange the drawer-like supporting structure 13 in an intermediate position between the retracted position and the completely extracted position.

Figure 11:
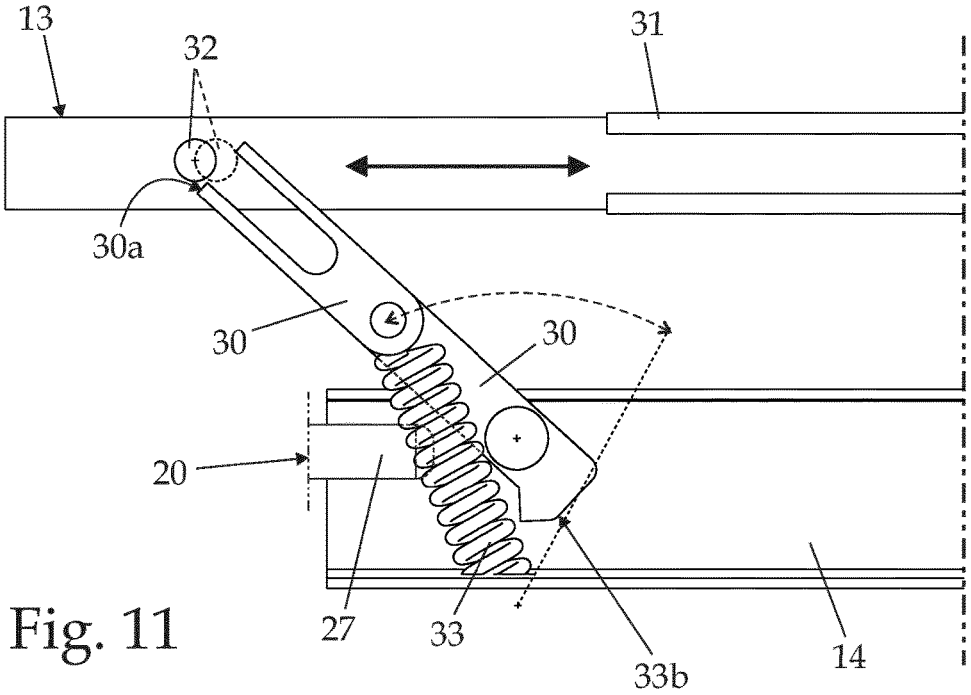

With reference to FIG. 11, in the second rest position the transversal pin 32 is furthermore allowed to disengage the first end 30*a* of the rocker arm 30 under the thrust of the push member 18, so as to allow the drawer-like supporting structure 13 to further move along the displacement direction d, towards the extracted position, under the thrust of push member 18.

Since in the second rest position the transversal pin 32 may disengage from the first end 30*a* of the rocker arm 30 also under the thrust of the user, in this embodiment the push member 18 is optional.

In other words, in this embodiment the elastic member 33 of the locking mechanism 19 operates also as push member that pushes the drawer-like supporting structure 13 out of the drawer housing 14, away from the retracted position.

Similarly to the previous embodiments, the manually-operated command device 20 preferably comprises a manually-operated push-bottom 21 which is preferably located on the appliance control panel 6, and is suitably structured so as to force, when pushed by the user, the flip-flop locking mechanism 19 to immediately switch from the first to the second working configuration.

More in detail, differently from the FIGS. 5, 6 and 7 embodiment, in this case the rigid rear stem 27 of the manually-operated push-bottom 21 is structured so as to engage in pass-through and axially sliding manner the pass-though hole realized on the bottom of the recessed seat 26, and to stick out of the front side of the drawer-like supporting structure 13 towards the front entrance or opening 14*a* of the drawer housing 14 so as to be able to abut, when the drawer-like supporting structure 13 is arranged in the retracted position, onto a preferably substantially cam-shaped second end 30*b* of the rocker arm 30.

Figure 9:
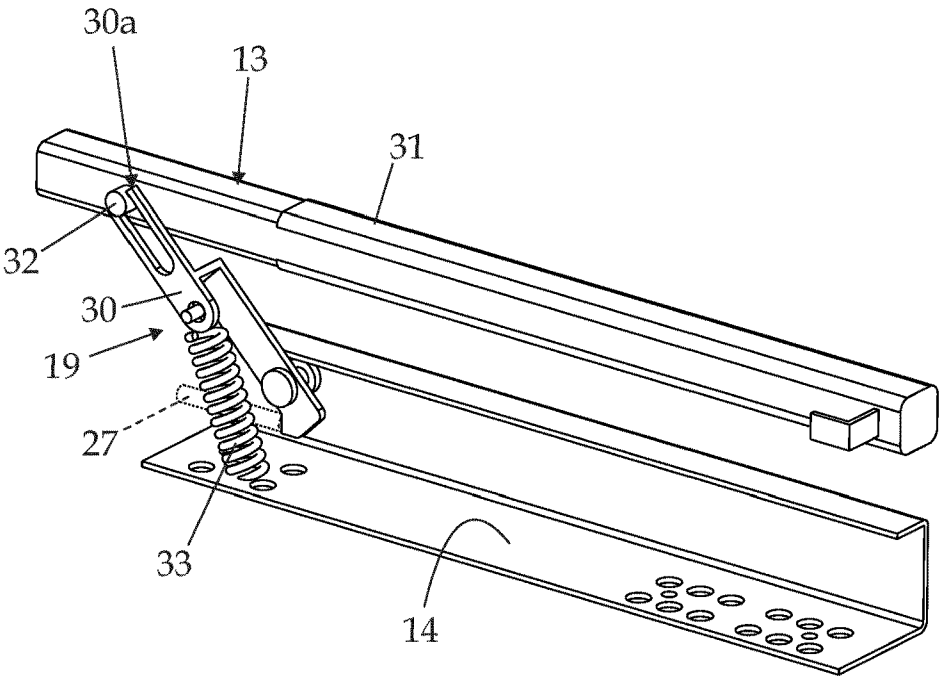
FIGS. 8 to 11 are four different views of several component of an alternative embodiment of the FIG. 1 laundry washing machine with parts in section and parts removed for clarity.
Figure 8:
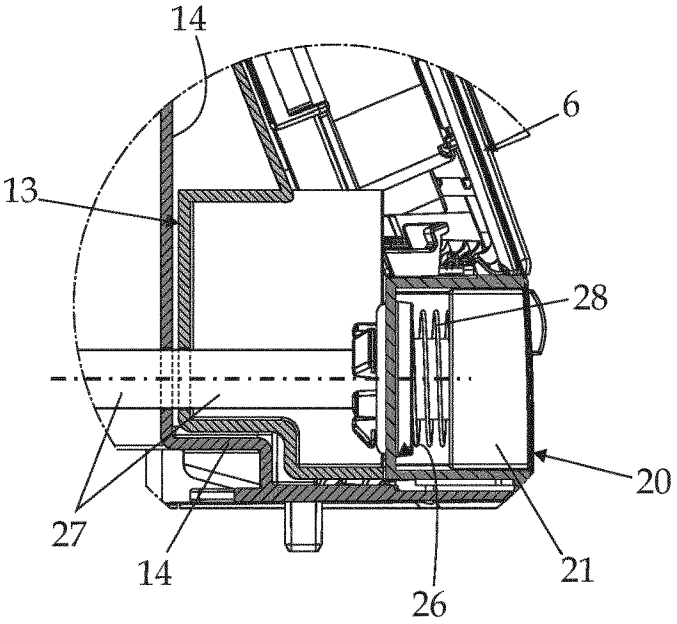
Figure 10:
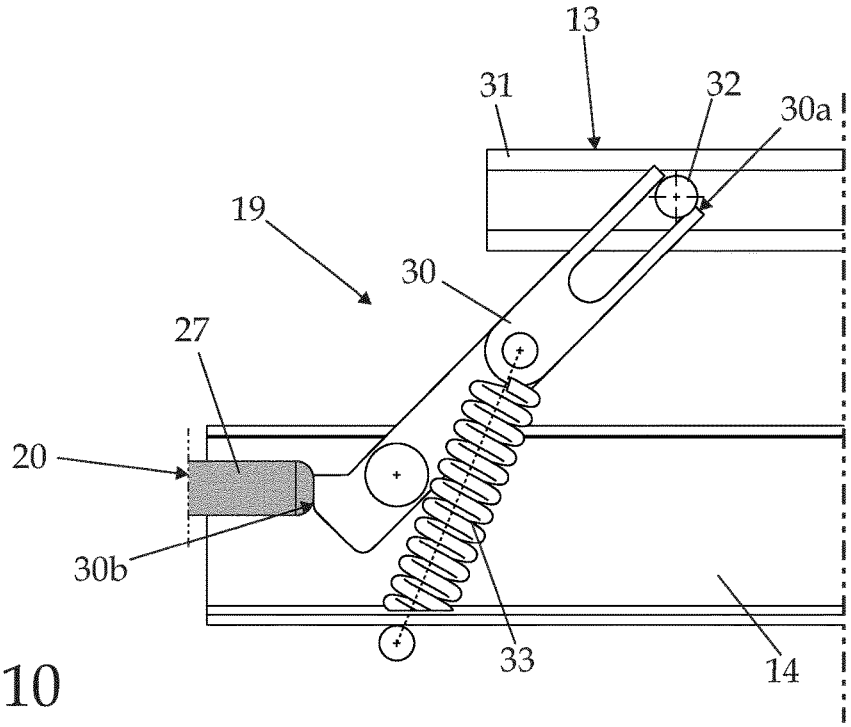

In this case the stroke of the manually-operated push-bottom 21 and the rigid stem 27 are specifically dimensioned so that the rigid stem 27 is capable of rotating/tilting, when the push-bottom 21 moves from the forward to the rearward position, the rocker arm 30 against the action of the elastic member 33 of an angle sufficient to cause the switching of the rocker arm 30 from the first rest position (see FIG. 10) to the second rest position (see FIGS. 9 and 11).

The invention claimed is:

1. A laundry washing machine comprising an outer casing, a washing tub which is arranged inside the casing with its opening or mouth directly facing a laundry loading/unloading opening formed on a front wall of the casing, a detergent dispensing assembly which is structured for supplying detergent into the washing tub, a fresh-water supply circuit which is structured for being connected to a water mains and for selectively channelling a flow of fresh water from the water mains to the detergent dispensing assembly and/or to the washing tub, and an appliance control panel which is structured for allowing a user to manually select a desired washing-cycle and is located on the front wall of the casing; the appliance control panel being located/arranged on a front side of a drawer-like supporting structure which is fitted/inserted in an extractable manner into a corresponding drawer housing which extends inside the casing underneath an upper worktop or a top wall of the casing, and communicates with the outside via a front entrance which is formed on the front wall of the casing above the laundry loading/unloading opening;

the drawer-like supporting structure being movable inside the drawer housing between a retracted position in which the drawer-like supporting structure is completely recessed inside the casing and the appliance control panel is arranged substantially coplanar to the front wall the casing, and a completely extracted position in which the drawer-like supporting structure partly juts out from the front wall of the casing such that the appliance control panel is spaced apart from the front wall of the casing;

the laundry washing machine further comprising: a push member which is able to elastically push the drawer-like supporting structure away from the retracted position and towards the extracted position; a locking mechanism which is structured to hold the drawer-like supporting structure in the retracted position and to prevent the push member from pushing the drawer-like supporting structure away from the retracted position; and a manually-operated command device which is structured so as to force, when manually operated, the locking mechanism to release the drawer-like supporting structure, thus allowing the push member to push the drawer-like supporting structure away from the retracted position.

2. A laundry washing machine according to claim 1, wherein the locking mechanism is at least partially arranged on the drawer-like supporting structure.

3. A laundry washing machine according to claim 2, wherein the locking mechanism is at least partially arranged on the front side of the drawer-like supporting structure, behind the appliance control panel.

4. A laundry washing machine according to claim 2, wherein the locking mechanism comprises a catch member which protrudes from the drawer-like supporting structure, and has its distal end structured so as to be able, when the drawer-like supporting structure is arranged in the retracted position, to engage in a stable, though easily releasable manner onto a corresponding engagement portion provided at the drawer housing.

5. A laundry washing machine according to claim 4, wherein the catch member is movable between a locking position wherein the distal end of the catch member is able to engage onto the drawer housing, and an unlocking position wherein the distal end of the catch member is forced to release the drawer housing, and in that the manually-operated command device is structured to selectively move, when manually operated, the catch member from the locking position to the unlocking position so as to force the catch member to release the drawer housing.

6. A laundry washing machine according to claim 4, wherein the catch member comprises a rocker arm which is pivotally jointed to the drawer-like supporting structure so as to be able to freely swing about a given rotation axis.

7. A laundry washing machine according to claim 5, wherein the locking mechanism comprises an elastic member which is structured to elastically keep/hold the catch member in the locking position.

8. A laundry washing machine according to claim 7, wherein said elastic member is arranged on the drawer-like supporting structure.

9. A laundry washing machine according to claim 1, wherein the locking mechanism is structured to selectively lock, when the drawer-like supporting structure is arranged in the retracted position, the drawer-like supporting structure to the drawer housing, so as to prevent any movement of the drawer-like supporting structure with respect to the drawer housing.

10. A laundry washing machine according to claim 1, wherein the locking mechanism is a flip-flop locking mechanism which is structured so as to able to selectively and alternatively assume a first working configuration wherein the locking mechanism elastically holds the drawer-like supporting structure inside the drawer housing in the retracted position overcoming the thrust of the push member, and a second working configuration wherein the locking mechanism elastically hold the drawer-like supporting structure in an intermediate position between the retracted position and the completely extracted position, and is furthermore unable to hold the drawer-like supporting structure stationary in said intermediate position; the flip-flop locking mechanism being also able to freely switch from one operating configuration to the other due to an external thrust.

11. A laundry washing machine according to claim 10, wherein the manually-operated command device is structured to selectively act on the flip-flop locking mechanism so as to force the flip-flop locking mechanism to switch from the first to the second working configuration.

12. A laundry washing machine according to claim 1, wherein the manually-operated command device is located on the appliance control panel.

13. A laundry washing machine according to claim 1, wherein the manually-operated command device is a manually-operated push-bottom.

14. A laundry washing machine according to claim 1, wherein the drawer-like supporting structure is provided with a handle portion which is arranged/located on the drawer-like supporting structure so as to remain inaccessible to the user when the drawer-like supporting structure is arranged in the retracted position, and to be easily accessible to the user when the drawer-like supporting structure is arranged away from the retracted position.

15. A laundry washing machine according to claim 1, wherein the detergent dispensing assembly comprises a single-dose detergent dispenser which is structured for selectively feeding into the washing tub a manually preloaded amount of detergent, softener and/or other washing agent sufficient for performing only a single washing cycle; and/or an autodosing detergent dispenser which is structured for automatically batching/dosing, on the basis of the selected washing cycle, the suitable amount/dose of detergent, softener and/or other washing agent to be used during the selected washing cycle and afterwards feeding said amount/dose of detergent, softener and/or other washing agent into the washing tub.

16. A laundry washing machine according to claim 15, wherein the single-dose detergent dispenser comprises a detergent drawer which is manually fillable with a quantity of detergent, softener and/or other washing agent sufficient for performing a single washing cycle, and which is fitted/inserted in a manually extractable manner into the corresponding drawer housing which extends inside the casing underneath the upper worktop or top wall of the casing, and communicates with the outside via a front entrance or opening of the drawer housing which is formed on the front wall of the casing above the laundry loading/unloading opening and horizontally beside the front entrance or opening of the drawer housing of the drawer-like supporting structure.

17. A laundry washing machine according to claim 1, wherein the detergent dispensing assembly is at least partially located/incorporated on the drawer-like supporting structure.

18. A laundry washing machine according to claim 1, further comprising an internal water softening device which is arranged/located inside the casing, along the fresh-water supply circuit, and is structured for reducing the hardness degree of the fresh water channeled to the detergent dispensing assembly and/or the washing tub.

19. A laundry washing machine according to claim 18, wherein said water softening device comprises: a water-softening agent container which is arranged/located along said fresh-water supply circuit so as to be crossed by the fresh water flowing towards the detergent dispensing assembly and/or directly to the washing tub, and is filled with a water softening agent able to reduce the hardness degree of the fresh water flowing through the same water-softening agent container; and a regeneration-agent reservoir which is: located/incorporated into the drawer-like supporting structure, structured for receiving a given quantity of consumable salt or other regeneration agent able to regenerate the water softening function of the water softening agents stored inside the water-softening agent container, and fluidically connected to the water-softening agent container for selectively transferring a mixture of water and salt or other regeneration agent to the water-softening agent container.

20. A laundry washing machine according to claim 1, wherein the drawer-like supporting structure is provided with one or more storage compartments which become accessible to the user when the drawer-like supporting structure is in the extracted position, at least one storage compartment also housing a hand-held, substantially pen-shaped, ultrasonic garment stain-removal tool.

* * * * *